United States Patent [19]

Morlino et al.

[11] 4,340,382

[45] Jul. 20, 1982

[54] METHOD FOR TREATING AND PROCESSING TEXTILE MATERIALS

[75] Inventors: Robert J. Morlino, Port Chester, N.Y.; Quintin W. Decker, St. Albans; Erich Marcus, Charleston, both of W. Va.

[73] Assignee: Union Carbide Corporation, Danbury, Conn.

[21] Appl. No.: 216,980

[22] Filed: Dec. 16, 1980

[51] Int. Cl.[3] ..... B01F 17/42; D06M 13/18

[52] U.S. Cl. ..... 8/137; 8/139; 252/8.9; 252/351; 568/625

[58] Field of Search ..... 8/137, 139; 252/8.9, 252/351; 568/625

[56] References Cited

U.S. PATENT DOCUMENTS

| | | | |
|---|---|---|---|
| 2,425,755 | 8/1947 | Roberts et al. | 260/615 |
| 2,448,664 | 9/1948 | Fife et al. | 260/615 |
| 2,674,619 | 4/1954 | Lundsted | 260/485 |
| 2,677,700 | 5/1954 | Jackson et al. | 260/488 |
| 2,965,678 | 12/1960 | Sundberg et al. | 260/615 |
| 3,036,130 | 5/1962 | Jackson et al. | 260/584 |
| 3,101,374 | 8/1963 | Patton | 260/584 |
| 3,770,701 | 11/1973 | Cenker et al. | 260/65 B |
| 3,887,624 | 6/1975 | Gipson et al. | 260/545 |
| 3,943,178 | 3/1976 | Stein et al. | 260/615 B |
| 3,956,401 | 5/1976 | Scardera et al. | 260/615 B |
| 4,070,298 | 1/1978 | Scardera et al. | 252/89 |
| 4,115,457 | 9/1978 | Wiedemann | 260/615 B |
| 4,134,854 | 1/1979 | Milligan | 252/351 |
| 4,171,455 | 10/1979 | Tomita et al. | 568/625 |

FOREIGN PATENT DOCUMENTS

| | | | |
|---|---|---|---|
| 2810703 | 9/1978 | Fed. Rep. of Germany | 568/625 |

*Primary Examiner*—Maria Parrish Tungol
*Attorney, Agent, or Firm*—George A. Skoler

[57] ABSTRACT

An improved method is provided for treating and processing textile materials which comprises contacting said textile materials with an aqueous composition containing a low-foaming, nonionic surfactive agent having a block-random structure represented by the formula:

R—O—Ax—B—H where R is a primary alkyl group having from 7 to 11 carbon atoms; A is oxypropylene groups; x is an integer of from 3 to about 15 and B is a random mixture of oxyethylene and oxypropylene groups having a molar ratio of oxyethylene to oxypropylene of from about 2:1 to about 5:1.

7 Claims, No Drawings

METHOD FOR TREATING AND PROCESSING TEXTILE MATERIALS

BACKGROUND OF THE INVENTION

This invention relates to a method for treating and processing textile fibers and fabrics and, more particularly, to an improved method for treating and processing textile fibers and fabrics with aqueous compositions which contain a liquid, low-foaming, surface active agent.

The manufacture of textile products requires the use of surface active agents in literally every phase of textile treating and processing. In many cases liquid compositions are involved, generally in an aqueous system to which a surface active agent is added. Surface active agents are used extensively as the sole additive, but more often, as integral parts of liquid compositions containing a variety of other ingredients depending on the particular phase of the textile processing that may be involved. Among the numerous applications in which surface active agents are used in the textile industry are for wetting out of fabric, removal of impurities, cleansing and lubrication of fibers, dyeing, dispersion of treating compounds such as solvents, softeners, water proofing and permanent press finishes, and the like.

Many such textile treating and processing operations use high speed equipment or involve vigorous agitation. Because of their inherent surface active properties, surface active agents usually generate foam in the aqueous processing bath. The foaming is generally undesirable since, for example, it can result in exceeding the capacity of the equipment used, can cause uneven application of treatment chemicals, can cause excessive foam in textile mill effluent and the like. Consequently, where foaming is a problem, antifoam additives or low-foaming surface active agents are used. Antifoam additives are very effective in preventing foaming, but add to the cost and complexity of the operation and may also result in compatibility problems with other components.

Nonionic surface active agents are widely used in textile operations where advantage is taken of their superior performance as a wetting agent, their detergency and scouring characteristics, as well as their adaptability for being combined with other types of surface active agents, resistance to hard water conditions, and lubricity characteristics. Although nonionic surface active agents as a class are generally low to moderate "foamers", they foam too much for many textile applications.

In recent years, a number of nonionic surface active agents have been developed and used commercially which are designated as "low-foaming". However, nonionic surfactants heretofore developed to meet low-foaming requirements have been found to have sacrificed other desirable characteristics such as wetting and scouring properties. Thus, the suitability of such compositions for use in many of the textile operations is limited and a number of different surface active agents are generally needed for the wide range of textile operations.

It has long been the practice to prepare nonionic surface active agents by the addition of ethylene oxide or mixtures of ethylene oxide and propylene oxide to various alcohols. Numerous different adducts have been prepared, some containing only oxyethylene groups while others contain a random distribution of oxyethylene and oxypropylene groups or discrete blocks of polyoxyethylene and polyoxypropylene. For example, in U.S. Pat. No. 3,101,374 to Patton, U.S. Pat. No. 2,674,619 to Lunsted, and U.S. Pat. No. 2,677,700 to Jackson et al. are disclosed compositions which are prepared by the addition of varying proportions and mixtures of alkylene oxides to reactive hydrogen compounds such as alcohols. More recent patents such as, for example, U.S. Pat. No. 3,770,701 to Cenker et al. and U.S. Pat. No. 3,956,401 to Scadera et al. disclose surfactant compositions prepared by the addition of specific proportions of ethylene oxide and propylene oxide to straight-chain aliphatic alcohols having 8 to 20 or 7 to 10 carbon atoms. The compositions disclosed in each of these patents are described as being biodegradable liquids which exhibit high detergency (U.S. Pat. No. 3,770,701) or low-foaming (U.S. Pat. No. 3,956,401) but it is not shown by either patentee that any of the compositions provide a combination of these properties or of other desirable surfactant properties such as superior wetting, nor, from the teaching thereof would one skilled in the art expect these patented compositions to exhibit such desirable combination of properties. Other recent patents such as, for example, U.S. Pat. Nos. 3,338,830 to Stokes et al.; 3,306,850 to Olsen; 3,943,178 to Stein et al.; 4,115,457 to Wiedemann, and U.K. Pat. No. 1,371,770 to Wiedemann disclose various nonionic surface active agents that are useful for specific textile applications, but it is not shown in these patents that the surface active agents are suitable for use or exhibit the necessary combination of properties required in the multitude of operations employed in the manufacture of textile fibers and fabrics.

SUMMARY OF THE INVENTION

In accordance with the present invention there is provided an improved method for treating and processing textile fibers and fabrics which comprises contacting said textile fibers or fabrics with an aqueous composition containing a low-forming, nonionic surface active agent having a block-random structure represented by the formula:

$$R—O—A_x—B—H$$

Wherein R is a primary alkyl group having from 7 to 11 carbon atoms; A is oxypropylene groups; x is an integer of from 3 to about 15 with the proviso that the sum of the number of carbon atoms in said alkyl group and $\frac{1}{3}$ of x is an integer in the range from 10 to about 12; and B is a random mixture of oxyethylene and oxypropylene groups having a molar ratio of oxyethylene to oxypropylene of from about 2:1 to about 5:1 with the total number of alkylene oxide groups in said mixture being such that the cloud point of said nonionic surface active agent is a liquid having a cloud point in the range from about 20° C. to about 60° C.

DESCRIPTION OF THE INVENTION

In accordance with the present invention there is provided an improved method for treating and processing textile fibers and fabrics which comprises contacting said textile fiber or fabric with an aqueous composition containing a liquid, low-foaming nonionic surface active agent having superior wetting characteristics, generally good scouring properties, and a cloud point of from about 20° C. to about 60° C., and preferably to about 40° C.

Surface active agents suitable for use in accordance with the practice of the invention comprise compositions obtained by reacting a primary aliphatic monohydric alcohol having from 7 to 11 carbon atoms, or mixtures thereof, with 3 to 15 moles of propylene oxide to form a block structure such that the sum of the number of carbon atoms in the alcohol moiety and $\frac{1}{3}$ of the number of oxypropylene groups is in the range from 10 to about 12, and then reacting the block adduct with an amount of a random mixture of ethylene oxide and propylene oxide in a molar ratio of EO to PO of from about 2:1 to 5:1 to prepare a liquid surface active agent having a cloud point in the range from about 20° C. to 60° C. The surface active agent composition may be represented by the formula:

$$R—O—A_x—B—M$$

wherein R is a primary alkyl group having from 7 to 11, and preferably, 8 to 10 carbon atoms; A is oxypropylene groups; x is an integer of from 3 to about 15 with the proviso that the sum of the number of carbon atoms in said alkyl group and $\frac{1}{3}$ of the value of x is in the range from 10 to about 12; and B is a random mixture of oxyethylene groups and oxypropylene groups in the molar ratio of oxyethylene to oxypropylene of from about 2:1 to about 5:1 with the total amount of said random mixture of oxyethylene being such that the surface active agent is a liquid having a cloud point in the range of from about 20° C. to about 60° C., and preferably, to about 40° C. The R—O in the foregoing formula may also be defined as the residue of the alcohol employed in the condensation reaction, i.e., the alcohol with the hydrogen in the OH radical removed. If a mixture of alcohols is employed in the condensation reaction, the product obtained will be a mixture of compounds having the foregoing formula, the compounds differing from each other in the number of carbon atoms in the alkyl group. It has been found that only surface active agent compositions prepared from primary monohydric alcohols having a particular number of carbon atoms and particular essential amounts of said alcohol, propylene oxide, and random mixtures of ethylene oxide and propylene oxide are the suitable combination and balance of low-foaming, superior wetting properties, enhanced detergency and/or scourability, and cloud points in the range from about 20° C. to about 60° C., achieved that are necessary for use in the wide variety of textile operations in accordance with the invention.

Alcohols which may be employed in the preparation of the suitable surface active agents are those primary, straight-and branched-chain aliphatic monohydric alcohols which contain 7 to 11, and preferably 8–10, carbon atoms in the chain. Mixtures of the alcohols may also be used. Exemplary suitable alcohols are 2-ethylhexanol; n-heptanol; 2,6-dimethyl-1-heptanol; n-octanol; 3,7-dimethyl-1-octanol; n-nonanol; n-decanol; n-undecanol; 2,4,4-trimethyl-1-pentanol; 2,3-dimethyl-1-pentanol; 2-propyl-1-heptanol and mixtures thereof.

Suitable surfactants are generally prepared by condensing an alcohol or mixture of alcohols, as described herein, with propylene oxide and a mixture of ethylene oxide and propylene oxide, in two distinct steps. In the first step, propylene oxide, or substantially only propylene oxide, is added to the alcohol and, in the second step, a mixture of ethylene oxide and propylene oxide is added to the reaction product of the first step. This procedure enables the preparation of nonionic surfactants which have a clock of oxypropylene groups proximate to the alcoholic portion of the surfactant and then oxyethylene groups and oxypropylene groups randomly distributed proximate to the oxypropylene block portion of the surfactant.

As mentioned above, surface active agents suitable for use in accordance with this invention have a block-random structure. Such products are generally prepared by condensing the alcohol with propylene oxide during the first step in the presence of an alkaline catalyst. Catalysts which may be employed include sodium hydroxide, potassium hydroxide, sodium acetate, trimethylamine and, preferably, an alkali metal alcoholate of the alcohol. Any other types of catalysts commonly used for alkylene oxide addition reactions with reactive hydrogen compounds may also be employed. After the condensation reaction in the first step is completed, a mixture of ethylene oxide and propylene oxide is added to the reaction mixture formed during the first step, generally until a product having the desired cloud point is obtained. No additional catalyst is usually required to carry out the second step of the reaction. The condensation reaction in both the first and second steps are preferably carried out at elevated temperatures and pressures. After the condensation reaction is completed, the catalyst is removed from the reaction mixture by any known procedure such as neutralization and filtration, or ion exchange.

It has been found that the nonionic surface active agents herein described exhibit the unique combination and balance of low-foaming, superior wetting and enhanced scouring which meets the requirements for most, if not all, textile operations when employed in aqueous treating and processing compositions. The range of cloud points that are possible with these compositions permits the selection of materials which would be most suitable for the variety of operations carried out by any particular fiber or fabric processor.

Aqueous compositions suitable for use in accordance with the practice of the invention, show little or no foaming, are stable to acids, dyes, salts and various types of water. Such compositions are highly suitable for wetting or penetrating textile fibers and fabrics either prior to subsequent operations or during particular operations; for washing or scouring textile materials such as cleaning textile materials prior to fabric finishing, dyeing, printing and the like and subsequent to such finishing operations to remove excess treating materials; and for emulsification of other ingredients in the compositions used for any number of fiber or fabric treatments. The textile materials may be in any of the forms occurring in textile production, such as, for example, loose fibers, filament, yarn, non-wovens, felts, carpets, woven, and knitted fabrics. Exemplary textile materials may be natural and regenerated cellulosic fibers, synthetic polyamides, wool, silk, polyacrylonitrile, polyester, and polyolefin fibers including blend fabrics of synthetic and natural fibers.

Aqueous compositions used in the various textile treating or processing operations of the invention contain the liquid low-forming nonionic surface active agent herein described in amounts of 0.01 percent to about 12 percent by weight, and preferably, 0.05 to 2 percent by weight. For example, in those applications where the nonionic surface active agent is the sole component of the composition, the treating compositions contain nonionic surfactants in amounts of 0.01 to 2 weight percent, and preferably from about 0.05 to 0.2 weight percent, of said nonionic surfactant. Such compositions are highly suitable for use as wetting agents, scouring agents, cleansing agents and the like. A special advantage of the treating and processing compositions used in accordance with the practice of the invention is their compatibility with most or all of the additives used in the various textile operations including, for example, inorganic builders, solvents, anionic surfactants and other nonionic surfactants that may be used in scouring baths; desizing enzymes and salts that may be used in desizing; bleaching agents, such as sodium hydroxide and sodium silicate; durable press resins, softeners, catalysts, and acids that may be used in durable press treatments; dyes, acids, and other auxiliaries for dyeing; water repellants formulations; printing dyes, thickeners etc.; fiber lubricants including silicone and organic oils, phosphate esters and other such materials.

Typical compositions used in various textile operations are, for example:

| | | |
|---|---|---|
| Wet-out (wet-out dry cloth for subsequent operations) | | |
| (a) | Nonionic surfactant | 0.05 to 1% by wt |
| | Water | 99 to 99.95 |
| (b) | Nonionic surfactant | 0.05 to 1% |
| | Sodium carbonate | 0.05 to 2% |
| | Water | quantity to 100% |
| Scouring | | |
| (a) | Nonionic surfactant | 0.1 to 1% |
| | Water | 99 to 99.9 |
| (b) | Nonionic surfactant | 0.1 to 1% |
| | Sodium tripolyphosphate | 0.1 to 2% |
| | Water | quantity to 100% |
| Solvent Scouring | | |
| | Nonionic surfactant | 0.05 to 1% |
| | Sodium tripolyphosphate | 0.1 to 2% |
| | "Varsol" solvent | 0.1 to 1% |
| | Water | quantity to 100% |
| Alkaline Scouring | | |
| (a) | Nonionic surfactant | 0.05 to 1% |
| | Sodium tripolyphosphate | 0.1 to 2% |
| | Sodium hydroxide | 0.1 to 3% |
| | Water | quantity to 100% |
| (b) | Nonionic surfactant | 0.05 to 1% |
| | Sulphated alcohol ethoxylate (anionic surfactant) | 0.05 to 1% |
| | Sodium pyrophosphate | 0.1 to 2% |
| | Water | quantity to 100% |
| Desizing | | |
| | Nonionic surfactant | 0.05 to 1% |
| | Enzyme | 0.1 to 1% |
| | Sodium chloride | 0.1 to 1% |
| | Water | quantity to 100% |
| Bleaching | | |
| | Nonionic surfactant | 0.05 to 2% |
| | Sodium silicate | 0.1 to 2% |
| | Water softener | 0.1 to 1% |
| | Sodium hydroxide | 0.1 to 1.5% |
| | Water | quantity to 100% |
| Jet Dyeing | | |
| | Nonionic surfactant | 0.1 to 1% |
| | Dye | 0.01 to 0.2% |
| | Dye carrier | 0.01 to 01% |
| | Sodium diphosphate; monobasic | 0.05 to 0.15% |
| | Water | quantity to 100% |
| Durable Press Treatment | | |
| | Nonionic surfactant | 0.05 to 1% |
| | Durable press resin | 10 to 15% |
| | Polyethylene softener | 1 to 3% |
| | Durable press resin catalyst | 1 to 3% |
| | Glacial acetic acid | 0.05 top 0.15% |
| | Water | quantity to 100% |

Each of such operations may be carried out in accordance with the present invention wherein the nonionic surface active agent component of this invention being advantageously employed as the nonionic surfactant in the typical formulations noted or other formulations that may be desired.

This invention will become more clear when considered together with the following examples which are set forth as being merely illustrative of the invention and which are not intended in any manner, to be limitative thereof. Unless otherwise indicated, all parts and percentages are by weight and all temperatures in degrees Centigrade.

EXAMPLE 1

Into a 2-liter, 4-necked, round-bottom flask equipped with a stirrer, thermowell, nitrogen purge, and heating mantle, 520 grams (4.0 moles) of 2-ethylhexanol was charged. The alcohol was heated to 40° C. with stirring, and the system was nitrogen-purged for 15 minutes. Flake 90 percent potassium hydroxide (8 grams—0.2 percent based on total charge) was added and the mixture was heated to 100° C. until the potassium hydroxide dissolved. A reflux-still head was added to the apparatus, the pressure was reduced to 12 mm Hg, and the mixture was heated to 100° C. for a one-hour period to remove water that was present. The reaction product was charged to a 1.5-gallon, stirred, stainless steel reactor in a nitrogen atmosphere and the reactor was then closed. A pressure of 5 psig of nitrogen was put on the reactor and the contents were heated to 100° C. The pressure in the reactor was adjusted to 10 psig and 1856 grams (32 moles) of propylene oxide were fed to the reactor at 110° C. using a laboratory recycle pump. The pressure was allowed to increase to 60 psig and the system was maintained at these pressure and temperature conditions while continuing to feed propylene oxide to the reactor. After the addition of propylene oxide was completed, about 4 hours, the system was "cooked out" at 110° C. for 3 additional hours, to insure complete reaction of the propylene oxide and was then cooled.

The reactor was then pressurized with nitrogen to 15 psig and heated to 110° C. The pressure was adjusted to 20 psig with nitrogen and a 75/25 weight percent mixture of ethylene oxide and propylene oxide was slowly fed to the reactor at 110° C. until the pressure was increased to 60 psig. The mixture of alkylene oxides was fed to the reactor at 110° C. while maintaining a pressure of 60 psig until the product was determined to have a cloud point of 20° C. When the addition of mixed oxides was completed the reaction mixture was "cooked out" at 110° C. for an additional 2 hours and then cooled.

Upon cooling, 1600 grams of the product (Sample A) was discharged from the reactor in a nitrogen atmosphere to a container containing glacial acetic acid. The reactor was then closed, heated to 100° C., pressurized to 5 psig with nitrogen and a 75/25 weight percent mixture of ethylene oxide and propylene oxide was slowly fed to the reactor at 110° C. until the pressure was increased to 60 psig. An additional amount of the mixture of ethylene oxide/propylene oxide was fed to the reactor at 110° C. while maintaining a pressure of 60 psig until the product was determined to have a cloud point of 42° C. The reaction mixture was "cooked out" at 100° C. for an additional 2 hours and then cooled. The cooled reaction product (Sample B) was discharged from the reactor in a nitrogen atmosphere to a container containing glacial acetic acid.

Each of the reaction products of this example (Sample A and B) were neutralized to a pH of 6.5 to 6.8 with additional glacial acetic acid while maintaining a nitrogen atmosphere and stripped at 100° C. at one mm Hg for one hour to remove any unreacted alkylene oxides.

Sample A was a clear liquid determined to have a molecular weight of 897; a cloud point (ASTM D 2024-65) in a 1 percent water solution of 20.5° C.; a, freezing point lower than −40° C.; and a surface tension at 25° C. in a 0.1 percent water solution of 31.3 dynes/cm. The product was determined to have a structure wherein a block of 8.4 oxypropylene groups were proximate the alcohol moiety and 4.8 oxyethylene groups and 1.2 oxypropylene groups were randomly distributed proximate the oxypropylene block.

Sample B was a clear liquid determined to have a molecular weight of 1125; a cloud point in a 1 percent water solution of 42° C.; a freezing point lower than −40° C.; and a surface tension at 25° C. in a 0.1 percent solution of 31.5 dynes/cm. The product was determined to have a structure wherein a block of 8.4 oxypropylene groups were proximate the alcohol moiety and 8.7 oxyethylene groups and 2.2 oxypropylene groups were randomly distributed proximate to the oxypropylene block.

Foaming, wetting, and scouring performance tests were run on the Sample A and Sample B products and the results are summarized in Table I.

TABLE I

| | | SAMPLE A | SAMPLE B |
|---|---|---|---|
| Carbon Atoms - alcohol moiety | | 8 | 8 |
| Sum of carbon atoms in alcohol and ⅓ of oxypropylene block groups | | 10.8 | 10.8 |
| EC/PO molar ratio in random mixture | | 4 | 4 |
| Cloud Point | | 20.5° C. | 42° C. |
| Poss-Miles Foam Test (ASTM-D 1173-53) | | | |
| 0.2% Surfactant distilled water | | | |
| 50° C. Initial Foam Height (mm) | | 14 | 75 |
| Final (mm) | | 4 | 16 |
| 25° C. Initial (mm) | | 20 | 111 |
| Final (mm) | | 6 | 16 |
| Draves Wetting (AATCC, Method 17-1977) | | | |
| 20-second wetting concentration 25° C. | | 0.057% | 0.069% |
| 40° C. | | — | 0.043% |
| Scouring Tests | | | |
| Test fabrics soil cloth, unfinished | | | |
| Terg-o-tometer, 0.1% surfactant conc. | | | |
| 150 ppm water Hardness, 50° C. | | | |
| 100% Cotton | Soil Removal Value (a) | 14 | 29 |
| | Redeposition Index (b) | 83 | 94 |
| Polyester/Cotton | Soil Removal Value (a) | 21 | 39 |
| | Redeposition Index (b) | 77 | 99 |

(a) Soil Removal Value $= \frac{A - B}{C - B} \times 100$ (b) Redeposition Index $= \frac{D}{C} \times 100$ where A = reflectance of soiled swatches after scouring
B = reflectance of soiled swatches before scouring
C = reflectance of unsoiled, unscoured swatches
D = reflectance of unsoiled, scoured swatches

EXAMPLE 2

Using the general procedure of Example 1, a series of nonionic surface active samples are prepared which have the structure and properties shown below in Table II. Foaming, wetting and scouring performance test results on each of the samples of this example are summarized in Table III. Performance tests are also run of commercial low-foaming nonionic surfactants for comparison and a summary of the results are also shown in Table III.

It is apparent from the performance tests shown in Table III that surface active agent Samples B to F and H to J exhibit a combination of low-foaming, superior wetting, and generally acceptable scouring characteristics that are suitable for a variety of textile operations, particularly when the cloud point of such surface active agent is at or near the temperature at which the operation may be performed. In contrast thereto, Sample A exhibits generally unsuitable wetting and scouring characteristics and Samples K and L exhibit generally unsuitable wetting characteristics at or near their cloud points. The Commercial product Samples do not exhibit a suitable combination of characteristics, Commercial Samples A and B being generally unsuitable in wetting and scouring characteristics, particularly at temperatures at or near their cloud points and commercial Samples C and D exhibit generally unsuitable wetting.

Commercial Product A is available commercially under the trademark designation Antarox LF-222 from GAF Corporation, Commercial Products B and D are available commercially under the trademark designation TERGITOL MIN-FOAM 2X and TERGITOL MIN-FOAM 1X respectively, from Union Carbide Corporation, and Commercial Product C is available commercially under the trademark designation Polytergent S-505-LF from Olin Corporation.

TABLE II

| SAMPLE | ALCOHOL | CARBON ATOMS ALCOHOL | PROPYLENE OXIDE BLOCK (GROUPS) | RANDOM EO/PO GROUPS | RANDOM EO/PO RATIO | SUM OF ALCOHOL CARBON ATOMS AND ⅓ PO BLOCK GROUPS | CLOUD POINT[(a)] °C. |
|---|---|---|---|---|---|---|---|
| A | 2-ethylhexanol | 8 | 2.9 | 4.8/2.0 | 2.4 | <9 | 22 |
| B | 2-ethylhexanol | 8 | 5.9 | 4.3/1.8 | 2.4 | 10 | 20 |
| C | 2-ethylhexanol | 8 | 6.1 | 4.5/1.1 | 4.1 | 10 | 20 |
| D | 2-ethylhexanol | 8 | 8.4 | 4.8/1.2 | 4.0 | 10+ | 20 |
| E | 2-ethylhexanol | 8 | 9.0 | 5.6/2.3 | 2.4 | 11 | 20 |
| F | Octanol | 8 | 8.0 | 3.8/0.95 | 4.0 | 10+ | 21 |
| G | 2-ethylhexanol | 8 | 2.7 | 7.1/3.0 | 2.4 | <9 | 40 |
| H | 2-ethylhexanol | 8 | 6.1 | 7.7/1.8 | 4.3 | 10 | 40 |
| I | 2-ethylhexanol | 8 | 8.4 | 8.1/1.6 | 5.1 | 10+ | 40 |
| J | Octanol | 8 | 8.0 | 6.8/1.7 | 4.0 | 10+ | 40 |
| K | Dodecanol | 12 | 2.0 | 3.0/1.0 | 3.0 | 12+ | 19 |

TABLE II-continued

| SAMPLE | ALCOHOL | CARBON ATOMS ALCOHOL | PROPYLENE OXIDE BLOCK (GROUPS) | RANDOM EO/PO GROUPS | RANDOM EO/PO RATIO | SUM OF ALCOHOL CARBON ATOMS AND ⅓ PO BLOCK GROUPS | CLOUD POINT[a] °C. |
|---|---|---|---|---|---|---|---|
| L | Dodecanol | 12 | 2.0 | 5.7/1.8 | 3.0 | 12+ | 38 |

TABLE III

| SAMPLE | ALCOHOL CARBON ATOMS | SUM CARBON ATOMS + ⅓ PO BLOCK | CLOUD POINT °C. | ROSS-MILES FOAM TEST FOAM HEIGHT (mm) 25° C. INITIAL | 25° C. FINAL | 50° C. INITIAL | 50° C. FINAL | DRAVES WETTING 20 SECOND SETTING CONCENTRATION (WEIGHT %) 25° C. | 40° C. | SCOURING (50° C.) 65/35, PE/COTTON SOIL REMOVAL | 65/35, PE/COTTON REDEPINDEX | 100% COTTON SOIL REMOVAL | 100% COTTON REDEPINDEX |
|---|---|---|---|---|---|---|---|---|---|---|---|---|---|
| A | 8 | <9 | 22 | 15 | 0 | 5 | 0 | 0.068 | — | 0 | 59 | 9 | 81 |
| B | 8 | 10 | 20 | 15 | 3 | 10 | 0 | 0.058 | — | 5 | 60 | 14 | 83 |
| C | 8 | 10 | 20 | 20 | 8 | 20 | 3 | 0.063 | — | 14 | 62 | 16 | 77 |
| D | 8 | 10+ | 20 | 20 | 6 | 14 | 4 | 0.057 | — | 21 | 77 | 14 | 83 |
| E | 8 | 11 | 20 | 60 | 9 | 15 | 4 | 0.057 | — | 8 | 57 | 9 | 77 |
| F | 8 | 10+ | 21 | 24 | 6 | 13 | 3 | 0.037 | — | 3 | 58 | — | — |
| G | 8 | <9 | 40 | 40 | 7 | 20 | 4 | — | 0.069 | 10 | 66 | 17 | 83 |
| H | 8 | 10 | 40 | 100 | 10 | 80 | 11 | — | 0.057 | 39 | 97 | 26 | 91 |
| I | 8 | 10+ | 40 | 115 | 13 | 67 | 16 | — | 0.055 | 38 | 97 | 27 | 91 |
| J | 8 | 10+ | 40 | 103 | 8 | 55 | 5 | 0.055 | 0.032 | 32 | 90 | — | — |
| K | 12 | 12+ | 19 | 88 | 7 | 4 | 1 | 0.068 | — | 7 | 61 | — | — |
| L | 12 | 12+ | 38 | 117 | 16 | 33 | 6 | 0.044 | 0.079 | 33 | 91 | — | — |
| Com. Prod. A | — | — | 22 | 20 | 6 | 0 | 0 | 0.063 | — | 0 | 61 | 12 | 85 |
| Com. Prod. B | — | — | 21 | 30 | 8 | 0 | 0 | 0.091 | — | 4 | 61 | 13 | 93 |
| Com. Prod. C | — | — | 47 | 120 | 17 | 35 | 3 | 0.069 | 0.067 | 20 | 77 | 20 | 87 |
| Com. Prod. D | — | — | 40 | 125 | 33 | 45 | 7 | 0.054 | 0.069 | 32 | 87 | 29 | 95 |

EXAMPLE 3

Using the nonionic surface active agent samples D and I of Example 2, durable press bath formulations are prepared using the following proportion of ingredients.

| | |
|---|---|
| Durable Press Resin[a] | 12.5 weight percent |
| Polyethylene Softener | 2.0 weight percent |
| Durable Press Resin Catalyst[b] | 2.5 weight percent |
| Glacial Acetic Acid | 0.1 weight percent |
| Nonionic Surface Active Agent | 0.1 weight percent |
| Water | 82.8 weight percent |

[a]dimethyloldihydroxyethylene urea
[b]magnesium chloride

Draves Wetting tests (AATCC-17-1974, 5 gram cotton skein, 3 gram hook) are run with bath formulations prepared with each of the surfactant samples and as a control on a bath formulation without any added surfactant and the results of these tests are reported in Table IV below.

TABLE IV

| Surfactant in Bath Formulation | Wetting Time, Seconds at 25° C. |
|---|---|
| None | 300–600 |
| Sample D | 13 |
| Sample I | 13 |

EXAMPLE 4

Using surface active agent Samples D and I from Example 2, an Alkaline Scour Formulation is prepared having the following proportion of ingredients:

| | |
|---|---|
| Sodium Hydroxide, TSPP | 3 weight percent |
| Sodium Pyrophosphate | 0.2 weight percent |
| Surfactant | 0.2 weight percent |
| Water | 96.6 weight percent |

Soil removal tests are run with scouring formulations containing each of the surfactant samples and, as a control, without any surfactant and the results are reported in Table V. The soil removal tests are run in a Terg-o-Meter, 100 RPM, at 50° C. and 60° C. on soil test cloths prepared from 65/35, Polyester/Cotton.

TABLE V

| Surfactant | Soil Removal Value[a] 50° C. | 60° C. |
|---|---|---|
| Sample D | 45 | 42 |
| Sample I | 49 | 40 |
| None | 14 | 15 |

[a]Soil Removal Value $= \frac{A - B}{C - D} \times 100$
A = reflectance of soiled swatches after scouring
B = reflectance of soiled swatches before scouring
C = reflectance of unsoiled, unscoured swatches
D = reflectance of unsoiled, scoured swatches

What is claimed is:

1. A method of treating and processing textile fibers and fabrics which comprise contacting said textile materials with an aqueous composition comprising at least about 0.01 percent by weight of a low-foaming, nonionic surface active agent having a block-random structure represented by the formula:

$$R—O—A_x—B—H$$

wherein R is a primary alkyl group having from 7 to 11 carbon atoms, A is oxypropylene groups, x is an integer of from 3 to about 15 with the proviso that the sum of number of carbon atoms in the alkyl group and of $\frac{1}{3}$ of value of x is in the range from 10 to about 12, and B is a random mixture of oxyethylene and oxypropylene groups in the molar ratio of oxyethylene to oxypropylene of from about 2:1 to about 5:1 with the total amount of said random mixture of oxyalkylene groups being such that the surface active agent is a liquid having a cloud point in the range from about 20° C. to about 60° C.

2. The method of claim 1 wherein R is a primary alkyl group having from 8 to 10 carbon atoms.

3. The method of claim 1 wherein said aqueous composition comprises up to about 12 percent by weight of said surface active agent.

4. The method of claim 1 wherein the textile treating composition contains from 0.01 to 2 weight percent of said surface active agent.

5. The method of claim 1 wherein R—O represents the residue of 2-ethylhexanol.

6. The method of claim 1 which is a process for washing or scouring a textile material.

7. The material of claim 1 which is a process for "wetting-out" a textile material.

* * * * *

UNITED STATES PATENT AND TRADEMARK OFFICE

CERTIFICATE OF CORRECTION

PATENT NO. : 4,340,382

DATED : Jul. 20, 1982

INVENTOR(S) : R. J. Morlino et al.

It is certified that error appears in the above—identified patent and that said Letters Patent is hereby corrected as shown below:

Column 2, line 40: Delete "forming" and substitute --foaming--.

Column 3, line 17, in the structural formula: Delete "M" and substitute --H--.

Signed and Sealed this

*Twenty-second* Day of *February 1983*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,340,382

DATED : July 20, 1982

INVENTOR(S) : Robert J. Morlino et al.

It is certified that error appears in the above—identified patent and that said Letters Patent is hereby corrected as shown below:

Column 12, line 16 (Claim 7): Delete "material" and substitute --method--.

Signed and Sealed this

Third Day of May 1983

[SEAL]

*Attest:*

GERALD J. MOSSINGHOFF

*Attesting Officer*

*Commissioner of Patents and Trademarks*